US006378417B1

(12) United States Patent
Miyazawa et al.

(10) Patent No.: US 6,378,417 B1
(45) Date of Patent: Apr. 30, 2002

(54) SWASH PLATE COMPRESSOR IN WHICH AN OPENING EDGE OF EACH CYLINDER BORE HAS A PLURALITY OF CHAMFERRED PORTIONS

(75) Inventors: Kiyoshi Miyazawa; Naoto Sunaga, both of Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/765,589

(22) Filed: Jan. 22, 2001

(51) Int. Cl.[7] ..... F01B 3/00
(52) U.S. Cl. ..... 92/71; 92/169.1
(58) Field of Search ..... 92/71, 169.1

(56) References Cited

U.S. PATENT DOCUMENTS

| | | | | |
|---|---|---|---|---|
| 172,102 A | | 1/1876 | Ellis | |
| 3,809,506 A | | 5/1974 | Malcosky | |
| 3,999,894 A | | 12/1976 | Nakayama et al. | |
| 4,586,874 A | * | 5/1986 | Higara et al. | 417/222 |
| 4,784,045 A | | 11/1988 | Terauchi | |
| 5,149,254 A | | 9/1992 | Riffe | |
| 6,050,783 A | * | 4/2000 | Ogura | 92/71 |
| 6,209,444 B1 | * | 4/2001 | Murakami et al. | 92/71 |
| 6,212,995 B1 | | 4/2001 | Hasegawa et al. | |

FOREIGN PATENT DOCUMENTS

| | | |
|---|---|---|
| JP | 280862 | 3/1990 |
| JP | 7091366 | 4/1995 |

* cited by examiner

*Primary Examiner*—F. Daniel Lopez
*Assistant Examiner*—Igor Kershteyn
(74) *Attorney, Agent, or Firm*—Baker Botts L.L.P.

(57) ABSTRACT

A swash plate compressor includes a cylinder block having therein several cylinder bores and a crank chamber. A drive shaft is rotatably supported in the cylinder block. Each of several pistons is slidably disposed within one of the cylinder bores. A swash plate is disposed in the crank chamber and is tiltably secured to the drive shaft. A bearing couples the swash plate to each of the pistons, so that the pistons are driven in a reciprocating motion within the cylinder bores. Several stepped, chamferred portions are formed in succession on an opening edge of each of the cylinder bores. The structure for the swash plate compressor according to this invention reduce or eliminates damage of the outer surface of pistons without increasing the weight of the swash plate compressor.

12 Claims, 2 Drawing Sheets

SWASH PLATE COMPRESSOR IN WHICH AN OPENING EDGE OF EACH CYLINDER BORE HAS A PLURALITY OF CHAMFERRED PORTIONS

BACKGROUND OF THE INVENTION

1. Field of the Invention

The present invention relates to a swash plate compressor for use in a vehicular air conditioning system. More particularly, it relates to a swash plate compressor, in which wear of the sliding surfaces of a piston and a cylinder bore is surpressed, without increasing the weight of the compressor.

2. Description of Related Art

Swash plate compressors are known in the art. For example, Japanese Patent Publication JP-A-7-180658 describes the construction of a known swash plate compressor. This compressor includes a cylinder block having a plurality of cylinder bores radially formed therein and arranged with respect to the central axis thereof and having a plurality of pistons, each of which is slidably received in a cylinder bore. Further, it includes a front housing, which is securely fixed to a front end surface of the cylinder block to form a crank chamber therebetween and a drive shaft axially extending through the crank chamber, such that the ends thereof are rotatably supported by the front housing and cylinder block, respectively, through radial bearings. Moreover, it includes a conversion mechanism, which comprises shoes, a swash plate, the drive shaft, and the pistons. The conversion mechanism is provided on the drive shaft within the crank chamber for converting a rotating motion of the drive shaft into a reciprocating movement of the pistons. The compressor also includes a cylinder head, which is securely fixed to a rear end surface of the cylinder block to form a suction chamber and a discharge chamber therebetween and a valve plate assembly, which is provided between the cylinder block and the cylinder head.

In operation, the drive shaft is rotated by the engine of a vehicle through a known belt and pulley arrangement. The rotation of the drive shaft is transferred to the swash plate, so that, with respect to the rotation of the drive shaft, the inclined surface of the swash plate moves axially to the right and left. The rotation of the inclined surface of the swash plate translates into reciprocating motion of the pistons. As the pistons reciprocate, refrigerant gas, which is introduced into the suction chamber from a fluid inlet port, is drawn into each cylinder and compressed. The compressed refrigerant gas is discharged to the discharge chamber from each cylinder bore through a discharge port and therefrom into an external fluid circuit, for example, a cooling circuit, through the fluid outlet port.

In such known swash plate compressors, when a suction stroke of a piston changes to a discharge stroke of the piston, the swash plate absorbs a large piston-inertial-force. Consequently, a force is transferred to the pistons, which is caused by a reaction force to the piston-inertial-force and is received from the swash plate through shoes. This reaction force causes the pistons to be partially pressed against an opening edge of the cylinder bore, in a radially outward direction; in other words, the pistons become inclined due to the rotation of the swash plate. As a result, in extreme cases, the reciprocating movement of the pistons is prevented.

Accordingly, in such known swash plate compressors, a swollen or flattened bore portion is formed on the front end surface of the cylinder block, and a portion of the piston, which passes beyond the cylinder bore during the suction stroke, is supported by the swollen bore portion of the cylinder block.

SUMMARY OF THE INVENTION

As a result of the undesirable wear of the opening edges of the cylinder bores, the occurrence of the inclination of the pistons against the central axis of the cylinder bore may be reduced. Further, as shown in enlarged portion 30" of FIG. 4, forming single-step chamferred portion 42 on the opening edge of cylinder bore 41 has been proposed in the known compressors, described above. According to this proposal, when such swash plate compressors are manufactured, the process of inserting the piston into the cylinder bore may be somewhat simplified.

Nevertheless, in such known swash plate compressors, because the swollen bore portion is formed on the front end surface of the cylinder block, extra material is unnecessarily used in the manufacture of the cylinder block. Therefore, the weight of the compressor is unnecessarily increased. Further, forming single-step chamferred portion 42 on the opening edge of cylinder bore 41 may be insufficient to reduce the occurrence of the inclination of the pistons against the central axis of the cylinder bore, when the pistons reciprocate.

An object of the present invention is to provide a swash plate compressor, which has a structure to effectively reduce the inclination of the pistons against the central axis of the cylinder bore.

In an embodiment of the present invention, a swash plate compressor comprises a cylinder block having therein a plurality of cylinder bores, a crank chamber, a suction chamber, and a discharge chamber. A drive shaft is rotatably supported in the cylinder block. Each of plurality of pistons is slidably disposed within one of the cylinder bores. A swash plate is disposed in the crank chamber and is tiltably secured to the drive shaft. A bearing couples the swash plate to each of the pistons, so that the pistons are driven in a reciprocating motion within the cylinder bores upon rotation of the swash plate. A plurality of stepped, chamferred portions are formed in succession on an opening edge of each of the cylinder bores.

In another embodiment, a swash plate compressor comprises a cylinder block having therein a plurality of cylinder bores, a crank chamber, a suction chamber, and a discharge chamber. A drive shaft is rotatably supported in the cylinder block. Each of pistons is slidably disposed within one of the cylinder bores. A swash plate is disposed in the crank chamber and is tiltably secured to the drive shaft. A bearing couples the swash plate to each of the pistons, so that the pistons are driven in a reciprocating motion within the cylinder bores upon rotation of the swash plate. A ring-shaped member is fitted into each of the cylinder bores. Each ring-shaped member has a plurality of stepped, chamferred portions formed in succession in an opening edge thereof.

Other objects, features, and advantages will be apparent to persons of ordinary skill in the art from the following description of the invention with reference to the accompanying drawings.

BRIEF DESCRIPTION OF THE DRAWINGS

The present invention may be more readily understood with reference to the following drawings, in which.

DETAILED DESCRIPTION OF PREFERRED EMBODIMENTS

Figure 1:
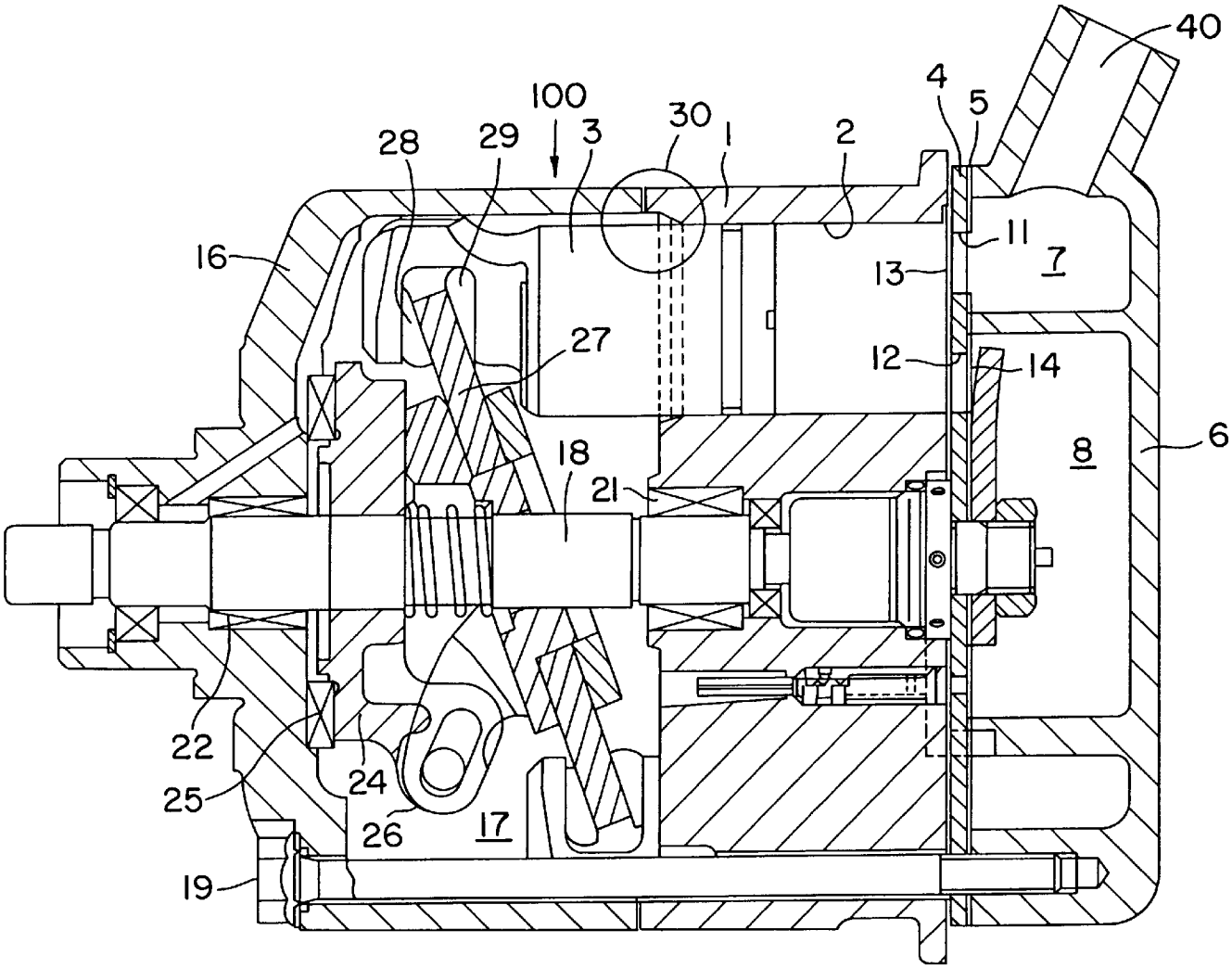
FIG. 1 is a longitudinal, cross-sectional view of a swash plate compressor, according to the present invention.

Referring to FIG. 1, a longitudinal, cross-sectional view of a swash plate compressor, which is called a variable displacement compressor of swash plate-type, is shown, according to the present invention. The compressor 100 includes cylinder block 1, cylinder head 6, and cup-shaped front housing 16. Cylinder block 1 has a plurality of cylinder bores 2 radially positioned therein and arranged about the central axis thereof. Each of a plurality of single head pistons 3 is slidably received into one of a corresponding plurality of cylinder bores 2. Cylinder head 6 is securely fixed to a rear end surface of cylinder block 1 to form a suction chamber 7 and a discharge chamber 8 therebetween, and valve plate 4 and gasket 5 are provided between cylinder block 1 and cylinder head 6. Front housing 16, cylinder block 1, and cylinder head 6 are fixed together by a plurality of bolts 19. Valve plate 4 divides suction chamber 7 and each of cylinder bores 2. Suction ports 11 and discharge ports 12 are formed on valve plate 4 and gasket 5. A suction valve 13 covers each of suction ports 11. A discharge valve 14 covers each of discharge ports 12. Front housing 16 is securely fixed to a front end surface of cylinder block 1 to form crank chamber 17 therebetween.

A drive shaft 18 axially extends through crank chamber 17, such that the ends thereof are rotatably supported by front housing 16 and cylinder block 1, respectively, through radial bearings 21, 22. Rotor 24 is fixedly mounted on drive shaft 18 in crank chamber 17. Thrust needle bearing 25 is interposed between rotor 24 and front housing 16. Swash plate 27 is attached to drive shaft 18. Swash plate 27 is coupled to rotor 24 through hinge mechanism 26 to be variable in its inclination angle. Drive shaft 18 and rotor 24 and swash plate 27 rotate together. Swash plate 27 is reciprocally slidable together with hemispherical shoes 28 and 29 parallel to the axis of drive shaft 18. Shoes 28 and 29 are disposed between each side surface of swash plate 27 and an inner surface of concave portions of pistons 3 for sliding along the side surface of swash plate 27.

When a driving force is transferred to the compressor from an external driving source (e.g., an engine of a vehicle) via a known belt and pulley arrangement (not shown), drive shaft 18 is rotated. The rotation of drive shaft 18 is transferred to swash plate 27, so that, with respect to the rotation of drive shaft 18, the inclined surface of swash plate 27 moves axially to the right and the left. Pistons 3, which are operatively connected to swash plate 27 by means of shoes 28 and 29, reciprocate within cylinder bores 2. The tilt angle of swash plate 27 with respect to drive shaft 18 changes according to the pressure of crank chamber 17. The crank chamber pressure is controlled by a known mechanism, which is, for example, described in U.S. Pat. No. 5,174,727, which is incorporated herein by reference. The stroke of piston 3 changes with respect to the variable of the tilt angle of swash plate 27, so that the capacity of the compressor changes.

As pistons 3 reciprocate in cylinder bores 2, refrigerant gas, which is introduced into suction chamber 27 from fluid inlet port 40, opens suction valve 13, is drawn into each cylinder bore 2 through suction ports 11, and is compressed. The compressed refrigerant gas opens discharge valve 14 and is discharged into discharge chamber 8 from each cylinder bore 2 through discharge ports 12 and therefrom into fluid circuit, for example, a cooling circuit, through a fluid outlet port (not shown).

When a suction stroke of piston 3 changes to a discharge stroke of piston 3, swash plate 27 absorbs a large piston-inertial-force. Consequently, piston 3 receives a transferred force, which is caused by a reaction to the piston-inertial-force, from swash plate 27 through shoes 28 and 29. As a result, because of the rotation of swash plate 27, a radially outer portion of outer surface of piston 3 is pressed in the radially outer direction, i.e., toward the outer part of the opening edge of inner surface of cylinder bore 2 that is positioned on the front end surface of cylinder block 1 and depicted in enlarged portion 30.

Figure 2:
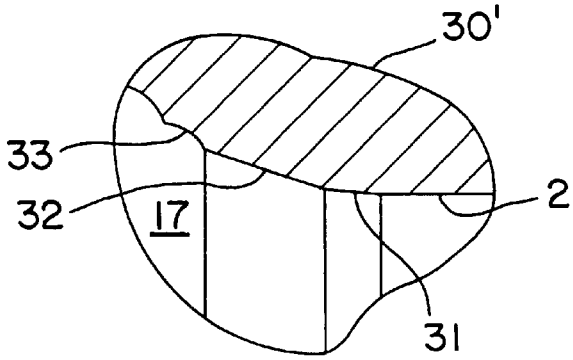
FIG. 2 is an enlarged view of portion 30' of the cylinder side wall depicted in FIG. 1.

With reference to enlarged portion 30' of FIG. 2, according to an embodiment of the present invention, a first chamferred portion 31, an inclination of which is comparatively small, and a second chamferred portion 32, an inclination of which is comparatively large, are formed on the opening edge of inner surface of cylinder bore 2, so that damage to the outer surface of piston 3 may be avoided. In other words, two, stepped, chamferred portions are formed on the opening edge of inner surface of cylinder bore 2. In this embodiment, damage to the outer surface of piston 3 may be reduced or eliminated without increasing the weight of cylinder block 1 because the whole of the opening edge of cylinder bore 2 has a comparatively smooth surface. As a result, seizures during the reciprocating movement of pistons 3 may be effectively reduced or eliminated. In this embodiment, the angle of inclination of first chamferred portion 31 may be in a range of about 3° to about 7° and preferably is about 5°; and the angle of inclination of second chamferred portion 32 may be in a range of about 16° to about 20° and preferably is about 18°. However, other values for the angles of inclination of first chamferred portions 31 and second chamferred portions 32 may be applicable and are within scope of the present invention. Surface 33 is a cast surface of cylinder block 1 that does not require a special machining process.

Figure 3:
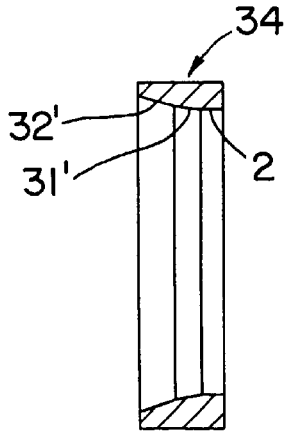
FIG. 3 is a cross-sectional view of a ring-shaped member according to the another embodiment of the present invention.
Figure 4:
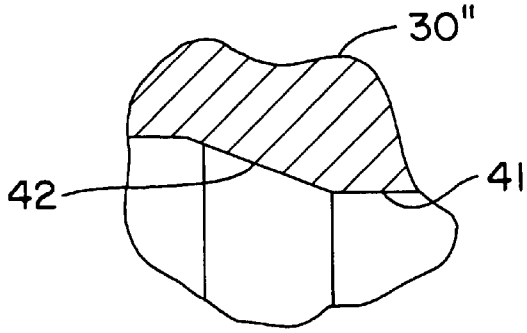
FIG. 4 is an enlarged view of portion 30" of a known swash plate compressor.

With reference to FIG. 3, according to another embodiment of the present invention, instead of forming two, stepped, chamferred portions on the opening edge of the inner surface of cylinder bore 2, a ring-shaped member 34, which has two, stepped chamferred portions 31' and 32' similar to first chamferred portion 31 and second chamferred portion 32, may be securely fixed to the opening edge of cylinder bore 2. In this embodiment, the number of ring-shaped members 34 is the same as the number of cylinder bores 2. In this embodiment, the opening edge of cylinder bore 2 may be machined to receive ring-shaped member 34. Each ring-shaped member 34 is fitted into the open edge of each cylinder bores 2, respectively. Therefore, two, stepped, chamferred portions 31' and 32' are formed on cylinder bores 2. Further, the material of ring-shaped member 34 may be equivalent to the material used in the manufacture of cylinder block 1, e.g., an aluminum alloy, or may be a resin, e.g., polyamide resin or polyimide resin, formed or strengthed to exhibit greater heat and wear resistance.

As described above, in the embodiments of the present invention of a swash plate compressor, damage of the outer surface of piston 3 may be effectively reduced or eliminated without increasing the weight of the swash plate compressor because the whole of the open edge of cylinder bore 2 has a comparatively smooth surface.

Although the present invention has been described in connection with preferred embodiments, the invention is not limited thereto. It will be understood by those skilled in the art that variations and modifications may be made within the scope and spirit of this invention, as defined by the following claims.

What is claimed is:

1. A swash plate compressor comprising:

a compressor housing including a crank chamber, a suction chamber, a discharge chamber, and a cylinder block;

a plurality of cylinder bores positioned in said cylinder block;

a drive shaft rotatably supported in said cylinder block;

a plurality of pistons, each of which is slidably disposed within one of said cylinder bores, a swash plate disposed in said crank chamber and tiltably secured to said drive shaft;

a bearing coupling said swash plate to each of said pistons, so that said pistons are driven in a reciprocating motion within said cylinders upon rotation of said swash plate; and a plurality of stepped, chamferred portions formed in succession on an opening edge of each of said cylinder bores.

2. The swash plate compressor of claim 1, wherein said chamferred portions of said cylinder bores are two stepped.

3. The swash plate compressor of claim 2, wherein the angle of inclination of a first chamferred portion is in a range of about 3° to about 7°, and wherein the angle of inclination of a second chamferred portion is in a range of about 16° to about 20°.

4. The swash plate compressor of claim 3, wherein the angle of inclination of the first chamferred portion is about 5°.

5. The swash plate compressor of claim 3, wherein the angle of inclination of the second chamferred portion is about 18°.

6. A swash plate compressor comprising:

a compressor housing including a crank chamber, a suction chamber, a discharge chamber, and a cylinder block;

a plurality of cylinder bores positioned in said cylinder block;

a drive shaft rotatably supported in said cylinder block;

a plurality of pistons, each of which is slidably disposed within one of said cylinder bores, a swash plate disposed in said crank chamber and tiltably secured to said drive shaft;

a bearing coupling said swash plate to each of said pistons, so that said pistons are driven in a reciprocating motion within said cylinders upon rotation of said swash plate; and a plurality of ring-shaped members, each of which is fitted into one of said cylinder bores, said ring-shaped member having a plurality of stepped, chamferred portions formed in succession in an opening edge thereof.

7. The swash plate compressor of claim 6, wherein a ring material of said ring-shaped member has equivalent heat and wear resistance to a material used to manufacture said cylinder block.

8. The swash plate compressor of claim 6, wherein a ring material of said ring-shaped member has greater heat and wear resistance than said material used to manufacture said cylinder block.

9. The swash plate compressor of claim 6, wherein said chamferred portions of said ring-shaped members are two stepped.

10. The swash plate compressor of claim 9, wherein the angle of inclination of a first chamferred portion is in a range of about 3° to about 7°, and wherein the angle of inclination of a second chamferred portion is in a range of about 16° to about 20°.

11. The swash plate compressor of claim 10, wherein the angle of inclination of the first chamferred portion is about 5°.

12. The swash plate compressor of claim 10, wherein the angle of inclination of the second chamferred portion is about 18°.

* * * * *